US005993154A

United States Patent [19]

Endres et al.

[11] Patent Number: 5,993,154

[45] Date of Patent: Nov. 30, 1999

[54] WELDED ROTOR OF A TURBO-ENGINE

[75] Inventors: Wilhelm Endres, Remetschwill; Fritz Schaub, Villnachern, both of Switzerland

[73] Assignee: Asea Brown Boveri AG, Baden, Switzerland

[21] Appl. No.: 08/975,823

[22] Filed: Nov. 21, 1997

[30] Foreign Application Priority Data

Nov. 21, 1996 [DE] Germany ..... 196 48 185

[51] Int. Cl.[6] ..... F01D 5/08

[52] U.S. Cl. ..... 416/96 R; 416/213 R; 416/200 A; 415/115

[58] Field of Search ..... 415/115; 416/96 R, 416/95, 97 R, 213 R, 198 A, 200 A, 201 R

[56] References Cited

U.S. PATENT DOCUMENTS 2,369,051 2/1945 Huber ..... 416/201
2,656,147 10/1953 Brownhill et al. ..... 416/97 R
5,507,620 4/1996 Primoschitz et al. ..... 416/96 R
5,593,274 1/1997 Carreno et al. ..... 415/115

FOREIGN PATENT DOCUMENTS

4324034A1 1/1995 Germany .
43-17121 4/1968 Japan ..... 416/198 A

*Primary Examiner*—Edward K. Look
*Assistant Examiner*—Richard Woo
*Attorney, Agent, or Firm*—Burns, Doane, Swecker & Mathis, L.L.P.

[57] ABSTRACT

In a turbo engine's welded rotor includes a number of disks, the radially or quasi-radially extending welding seams are intermediately interrupted by annular cavities through which a cooling medium flows, and these cavities are surrounded by a circumferentially extending insert ring. This insures the flow of the cooling medium through the entire rotor without reducing the strength of the welding bond.

9 Claims, 2 Drawing Sheets

WELDED ROTOR OF A TURBO-ENGINE

BACKGROUND OF THE INVENTION

1. Field of the Invention

The invention relates to a welded rotor of a turbo engine.

2. Brief Description of the Related Art

In modern turbo machines, the cooling of thermally highly stressed units is becoming ever more important. In particular, this includes the cooling of the rotor and rotor blades which require a high cooling intensity. According to one method, it is known that part of the compressed air is branched off for cooling purposes and is returned after cooling to the operating mass flow. Since modern gas turbines per se have only a limited air supply, this branching off of air for cooling purposes is always connected with a certain degree of lost effectiveness. Recently, therefore, there have been suggestions for cooling thermally loaded aggregates of a gas turbine with other cooling media, e.g., a cooling medium that is preferably available in an adequate amount and with cooling quality.

When cooling the rotor and then transferring the cooling medium to the rotor blades of the gas turbine, it must be assumed that in such a rotor-internal cooling system, in particular if cooling steam is being used, it is easy for stagnating steam spaces to be created in which deposits, accumulations of condensation during start-up, as well as corrosion processes then necessarily may occur during standstill. This additionally causes the highly stressed parts to have a tendency for stress corrosion, reducing the availability of the system.

The described risks during steam cooling are even more accentuated for welded rotors, i.e., rotors consisting of disks welded together, in particular if less ductile types of steel which tend towards stress corrosion cracking are used.

In addition, it must be taken into consideration that the rotor-internal channels through which the cooling medium flows must be provided with intermediary annular cavities in the plane of the radially welding seams, and where these cavities are absolutely required so that the cooling medium can flow through them and be transferred to the cooling rotor blades, whereby the type of welding technology used for the transition of the radially or quasi-radially extending welding seams near these cavities is important for the operating quality of such a rotor.

SUMMARY OF THE INVENTION

The present invention overcomes these and other deficiencies in the prior art. The present invention is based on the provision of means for eliminating the above mentioned disadvantages in a rotor of the initially mentioned type, cooled with an actually efficient cooling medium.

For this purpose, the invention suggests that the cooling medium is guided in a gas turbine engine in such a way that it is conducted by way of an axial inflow that takes place in most cases in the shaft center at its end in a radially or quasi-radially direction towards the outside, that this cooling medium is then permitted to flow axially or quasi-axially to the individual feet of the rotor blades being cooled, and to design the backflow, up to the point of the cooling steam outlet from the rotor, in such a way that this cooling stream outflow is preferably an annular channel that extends concentrically to the cooling medium inlet.

The essential advantage of this invention is that even in the case of a gas turbine rotor including disks welded together, the cooling can be performed with a steam volume, whereby the cooling cycle is hermetically sealed inside the rotor and only passes through forged or weld material. The annular cavities present in the area of the welding seams and used to transfer the cooling medium to the individual rotor blades to be cooled takes place without a negative effect on the mechanical properties of the welding seams. In addition, the design of these cavities is such that the continuation of the radially or quasi-radially extending welding seams can be performed in an optimal manner in terms of welding technology.

Mechanical seals are provided only for the blade feet, if the respective rotor blades should also be cooled, and in the area of the inspection openings or dust separators, if these are necessary for operation.

The rotor-internal cooling system is therefore formed by tangential cooling channels extending circumferentially in such a way that the cooling medium is distributed along the circumference and flows into axial or angled cooling channels.

Another advantageous design of the intermediary, annular cavities includes accomplishing the transition and continuation of the radially or quasi-radially extending welding seams required there by using an insert ring provided preferably with a web extending into the cavity. This insert ring then assumes the centering and radial support during the welding of the continued welding seam. The web also has holes that are located on the outside of the greatest radius of the web and through which the cooling medium is able to flow within the respective annular cavity. When using the steam suggested here on a preferential basis, the fact that condensation water forms during start-up cannot be prevented; this water can be removed through the mentioned holes to the rear part of the rotor.

Radially extending slits absorb the thermal expansion of the webs, whereby the above-mentioned holes for removing the condensation water protect the ends of the mentioned slits from stress concentration.

Another perceived advantage of the invention is that these slits in the web are able to absorb its tangential expansion, at least during the start-up procedure of the system.

Advantageous and useful further developments of the solution for this task according to the invention are characterized in the additional, dependent claims.

Still other objects, features, and attendant advantages of the present invention will become apparent to those skilled in the art from a reading of the following detailed description of embodiments constructed in accordance therewith, taken in conjunction with the accompanying drawings.

BRIEF DESCRIPTION OF THE DRAWINGS

The invention of the present application will now be described in more detail with reference to preferred embodiments of the apparatus and method, given only by way of example, and with reference to the accompanying drawings, in which.

DESCRIPTION OF THE PREFERRED EMBODIMENTS

Figure 1:
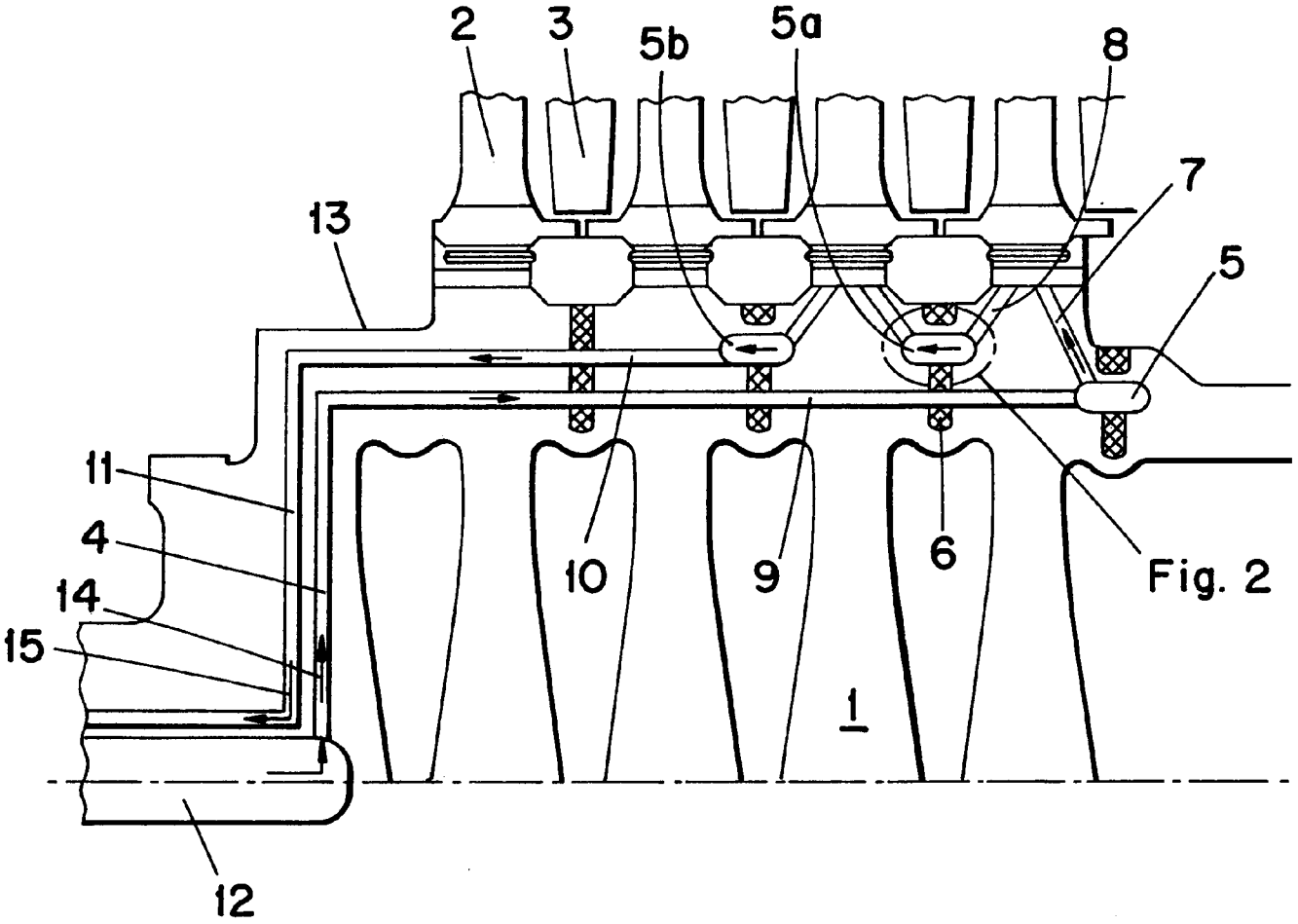
FIG. 1 illustrates a rotor-internal cooling system.

Referring to the drawing figures, like reference numerals designate identical or corresponding elements throughout the several figures.

All elements that are not necessary for the direct understanding of the invention have been omitted. Flow direction is indicated with arrows.

FIG. 1 illustrates a rotor-internal cooling system as used for the rotors of turbo-engines, in particular, gas turbines. The rotor 1, which is equipped with rotor blades 2, includes of a number of welded disks, as is shown in the progression of the welding seams 6. Stator blades 3, which belong to the stator of the same turbo 15 engine, are shown between the rotor blades 2. A system of channels, through which the cooling medium 14 flows and which are distributed in the circumferential direction of the rotor 1, extends through the axial direction of the rotor 1 in such a way that the rotor blades 2 can be cooled by way of branch-offs provided correspondingly either in parallel or serially. In this regard, FIG. 1 shows that the cooling of the rotor blades 2 is accomplished with serially switched components. From a rotor-internal cooling medium main cavity 12, at least one inflow channel 4 branches off, passing initially from the middle of the rotor 1 outward. In the area of the rotor exterior surface 13, preferably a separator of dust particles (not shown) is associated with each inflow channel 4. Said inflow channel 4 then changes down-stream from such a separator into an essentially axially extending additional inflow channel 9. This inflow channel 9 ends at the end of the rotor blade-equipped rotor 1 in a rotor-internal annular cavity 5, from where a first rotor blade 2 or a series of rotor blades is cooled via a branch-off channel 7. The backflow of the used cooling medium 14 from the cooled rotor blade 2 is accomplished via another branch-off channel 8, which itself ends intermediately in another rotor-internal, annular cavity 5*a*, whereby the remaining rotor blades are cooled from here analogously in a successive manner. From a last rotor-internal, annular cavity 5*b*, a corresponding number of axially extending outflow channels 10 branch off, through which the thermally spent cooling medium 15 is returned. This outflow channel 10 then changes in the area of the separator (not shown) into a radially or quasi-radially extending return channel 11, which returns the cooling medium 15 to another consumer (not shown) or removes it from the rotor 1. The cooling medium 15 used here should preferably be steam, e.g., available in any case in a sufficient amount and quality with regard to cooling effectiveness from a combination system (gas/steam system).

Figure 2:
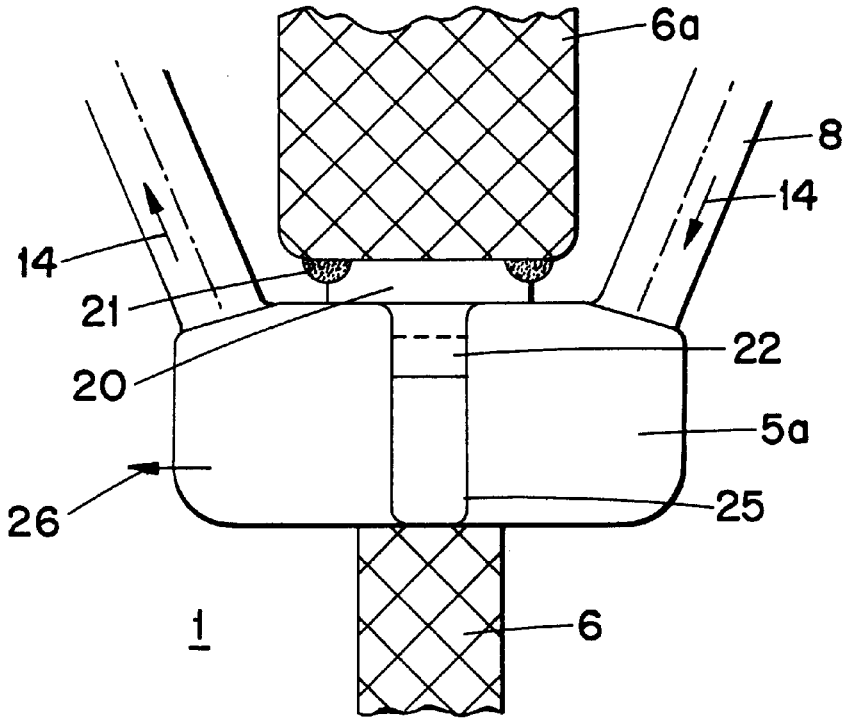
FIG. 2 illustrates a welded transition of a rotor-internal cavity formed by an insert ring.

FIG. 2 illustrates the part shown in FIG. 1 in the area of the rotor-internal, annular cavity 5*a*, and FIG. 1 illustrates the continuation (not shown) of the rotor weld, which is interrupted in its radial extension by said cavity 5*a*. An annular insert ring 20 connected via a welding seam 21 with a rotor 1, which can be attached from the outside, is equipped with a web 25 that projects into the cavity 5*a*, which brings about the centering and the radial support during welding. The web 25 of the insert ring 20 is also equipped with holes 22, so that the cooling medium 14 can be passed through the cavity 5*a*. The removal of condensation water when using water steam as a cooling medium must be ensured up to the back end of the rotor 1.

Figure 3:
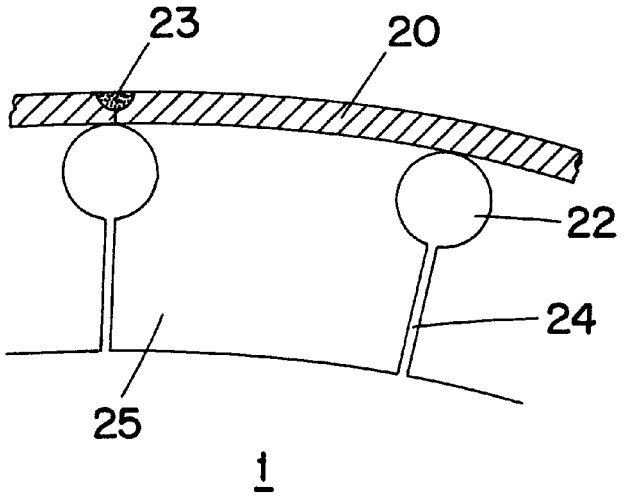
FIG. 3 illustrates an axial view of the insert ring according to FIG. 2.

FIG. 3 is an axial view of the insert ring according to FIG. 2 and illustrates the arrangement of the holes 22, through which the cooling medium passes inside the cavity (see FIGS. 1 and 2, Nos. 5, 5*a*, 5*b*). These holes 22 are arranged on the outside on the greatest radius of the web 25. When using steam as a coolant, it is inevitable that condensation water forms during start-up, which can then also be removed through holes 22, whereby this condensation water must be flushed up to the back end of the rotor (see FIG. 2, No. 26). Starting from the holes 22, radially extending slits 24 protect the bridges 25, in particular from tangentially occurring thermal expansion during the start-up process and in the transient load areas of the system. The end of the slits 24 themselves are protected by said holes 22 from a stress direction, so that they can be easily attached from the outside, and can then be easily connected with each other by longitudinal welding seams 23.

While the invention has been described in detail with reference to preferred embodiments thereof, it will be apparent to one skilled in the art that various changes can be made, and equivalents employed, without departing from the scope of the invention.

What is claimed is:

1. A welded rotor of a turbo engine, through which a cooling medium can flow via rotor-internal inflow and outflow channels, comprising a plurality of disks connected by radially extending welding seams, each welding seam including a radially inner portion and a radially outer portion, each of said radially extending welding seams being intermediately interrupted by a rotor-internal, annular cavity radially between said radially inner portion of said welding seam and said radially outer portion of said welding seam through which the cooling medium can flow, said cavities surrounded by at least one insert ring extending circumferentially therearound, a continuation of a welding seam being provided on said insert ring.

2. The rotor as claimed in claim 1, further comprising said cooling medium flowing through said cavities and wherein said cooling medium is steam.

3. The rotor as claimed in claim 1, wherein said cavities have a greater axial width than that of said welding seams.

4. The rotor as claimed in claim 1, wherein said at least one insert ring has a web projecting into a corresponding cavity, said web centering and radially supporting said continuation of said welding seam.

5. The rotor as claimed in claim 4, wherein said web is provided with holes through which said cooling medium can flow within said cavity.

6. The rotor as claimed in claim 5, wherein inflow of cooling medium into said cavities and its outflow therefrom is at a distance that, from the center of the rotor, is greater than the distance from a flowing plane of the cooling medium through said holes of said web.

7. The rotor as claimed in claim 5, wherein said web has an outermost radius, and said holes are arranged on said outermost radius.

8. The rotor as claimed in claim 5, wherein said web has an outermost radius, and said holes include portions which are tangential to said outermost radius of said web.

9. The rotor as claimed in claim 5, wherein said web comprises at least one radially extending slit connected with one of said holes and directed towards the rotor center.

* * * * *